US006294770B1

(12) United States Patent
Hasegawa et al.

(10) Patent No.: US 6,294,770 B1
(45) Date of Patent: Sep. 25, 2001

(54) RETICULATE HEATER

(75) Inventors: Shiro Hasegawa, Zama; Hiroshi Kurata, Tama, both of (JP)

(73) Assignee: Showa Electric Wire & Cable Co., Ltd. (JP)

( * ) Notice: Subject to any disclaimer, the term of this patent is extended or adjusted under 35 U.S.C. 154(b) by 0 days.

(21) Appl. No.: 09/611,950

(22) Filed: Jul. 6, 2000

(30) Foreign Application Priority Data

Jul. 13, 1999 (JP) ..... 11-198861
Oct. 8, 1999 (JP) ..... 11-288391

(51) Int. Cl.[7] ..... H05B 3/50

(52) U.S. Cl. ..... 219/544; 219/201; 219/528; 219/549

(58) Field of Search ..... 219/200, 201, 219/202, 204, 212, 217, 544, 545, 548, 549, 528, 529

(56) References Cited

U.S. PATENT DOCUMENTS 4,841,124 * 6/1989 Cox et al. ..... 219/201
5,410,127 * 4/1995 LaRue et al. ..... 219/212
5,484,983 * 1/1996 Roell ..... 219/545

* cited by examiner

*Primary Examiner*—Tu Ba Hoang
(74) *Attorney, Agent, or Firm*—Lorusso & Loud

(57) ABSTRACT

A reticulate heater has a net-mesh-like-structured heat generator 2 including a plurality of heater wires 20 each having the same wire diameter of from 0.02 to 0.12 mm. The plurality of heater wires 20 are formed into the net-mesh-like-structured heat generator 2 by a tricot knitting technique wherein loops are vertically formed by vertically knitting the heater wire on a continuous and planar basis. The knit meshes of the tricot knitting each have a pitch of 0.5 to 5 mm. Also, the heater wires may be the ones prepared by covering the heater bare wires with a for-enamel-wire coating. Further, the net-mesh-like-structured heat generator 2 may be the one including a plurality of first heater wires each consisting of a heater bare wire only and a plurality of second heater wires each prepared by covering the heater bare wire with a for-enamel-wire coating, the first and second heater wires being formed into the net-mesh-like-structured heat generator by a tricot knitting technique. As a result of this, the reticulate heater can be close adhered also to a complex curved surface. In addition, the reticulate heater can be also brought to a state of its being electrically very stable. Also, it can be arranged that a prescribed amount of heat generated be obtained.

10 Claims, 5 Drawing Sheets

(a)

(b)

(a)

(b)

RETICULATE HEATER

BACKGROUND OF THE INVENTION

FIELD OF THE INVENTION

The present invention relates to a reticulate heater. More particularly, the invention concerns a reticulate heater, which is used on a handle or seat of an automobile, an elbow portion of a complex piping, or the like.

DESCRIPTION OF THE RELATED ART

When in a cold district one rides in an automobile in a severe winter season and grips the handle, it sometimes happens that the palms of the hands get frozen onto the handle due to the water content of their skins. Therefore, providing a heater on the handle has hitherto been proposed. This kind of heater for use on the handle is demanded to rise in temperature in a short time and also to give comfortableness with no unnatural feel of gripping to the driver when he has gripped the handle. These requirements become able to be satisfied for example by putting a reticulate heater on the handle.

However, in case that knitting heater wires into a structure of net meshes, the heater wires become likely to come up at the intersecting points where the heater wires intersect each other. Therefore, there is the likelihood that the heater wires will come up to a covering for covering the heater and that also the heater will become electrically unstable.

With respect to this drawback, it is considered to dispose the heater at a central-in-cross-section portion of the material constituting the handle. However, even when using a heater generating a large amount of heat, a significantly large length of time is inconveniently needed to increase the temperature on account of a delay in the conduction of the heat.

SUMMARY OF THE INVENTION

The present invention has been made in order to solve the above-described conventional drawbacks and has an object to provide a reticulate heater which can be close adhered to a complex curved surface as well and which can be also electrically stabilized very much.

Another object of the invention is to provide a reticulate heater which can be close adhered to a complex curved surface as well and which enables the procurement of a constant amount of heat.

To attain the above object, according to the invention, there is provided a reticulate heater which comprises a net-mesh-like-structured heat generator including a plurality of heater wires each having the same wire diameter of from 0.02 to 0.12 mm, the plurality of heater wires being formed into the net-mesh-like-structured heat generator by a tricot knitting technique wherein loops are vertically formed by vertically knitting the heater wire on a continuous and planar basis, the knit meshes of the tricot knitting having a pitch of 0.5 to 5 mm.

According to the reticulate heater of the invention having the above-described construction, since the heat generator is formed with a tricot knitting technique, the reticulate heater has high elasticity and flexibility. Therefore, the reticulate heater can be close adhered to a complex curved surface as well. Also, the heater wire does not rise at the intersecting portions where the heater wires intersect each other. Therefore, the reticulate heater is electrically stabilized.

Also, according to the invention, there is provided a reticulate heater which comprises a net-mesh-like-structured heat generator including a plurality of heater wires each having the same wire diameter of from 0.02 to 0.12 mm and prepared by covering a heater bare wire with a for-enamel-wire coating, the plurality of heater wires being formed into the net-mesh-like-structured heat generator by a tricot knitting technique wherein loops are vertically formed by vertically knitting the heater wire on a continuous and planar basis, the knit meshes of the tricot knitting having a pitch of 0.5 to 5 mm.

According to the reticulate heater of the invention having the above-described construction, since the heat generator is formed with a tricot knitting technique, the reticulate heater has high elasticity and flexibility. Therefore, the reticulate heater can be close adhered to a complex curved surface as well. In addition, the heater wire is reliably insulated by a for-enamel-wire coating at the intersecting portions where the heater wires intersect each other. Therefore, the resistance value of the heat generator can be made stable. As a result of this, it becomes possible to obtain a stable constant amount of heat generated.

Also, according to the invention, there is provided a reticulate heater which comprises a net-mesh-like-structured heat generator including a plurality of first heater wires each having the same wire diameter of from 0.02 to 0.12 mm and each consisting of a heater bare wire only and a plurality of second heater wires each prepared by covering the heater bare wire with a for-enamel-wire coating, the plurality of first heater wires and second heater wires being formed into the net-mesh-like-structured heat generator by a tricot knitting technique wherein the loops are vertically formed by vertically continuously knitting the first and second heater wires on a planar basis and so that fellow ones of the first heater wires will not intersect each other, the knit meshes of the tricot knitting having a pitch of 0.5 to 5 mm.

According to the reticulate heater of the invention having the above-described construction, since the heat generator is formed with a tricot knitting technique, the reticulate heater has high elasticity and flexibility. Therefore, the reticulate heater can be close adhered to a complex curved surface as well. In addition, the heater wire can be reliably insulated by a for-enamel-wire coating by the second heater wires being knitted in so that fellow ones of the first heater wires will not intersect each other. Therefore, the resistance value of the heat generator can be made stable. As a result of this, it becomes possible to obtain a stable constant amount of heat generated.

Also, according to the invention, there is provided a reticulate heater which comprises a net-mesh-like-structured heat generator including a plurality of heater bare wires each having the same wire diameter of from 0.02 to 0.12 mm, the plurality of heater bare wires being formed into the net-mesh-like-structured heat generator by a tricot knitting technique wherein loops are vertically formed by vertically knitting the heater wire on a continuous and planar basis, the knit meshes of the tricot braiding having a pitch of 0.5 to 5 mm, the plurality of heater bare wires that are formed into the net-mesh-like-structured heat generator by a tricot knitting technique being insulation processed.

According to the reticulate heater of the invention having the above-described construction, since the heat generator is formed with a tricot knitting technique, the reticulate heater has high elasticity and flexibility. Therefore, the reticulate heater can be close adhered to a complex curved surface as well. In addition, the plurality of heater bare wires, which have formed the net-mesh-like-structured heat generator, are each insulation processed. And therefore the resistance value of the heat generator can be made stable. As a result of this, it becomes possible to obtain a stable constant amount of heat generated.

Also, according to the invention, there is provided a reticulate heater in which, preferably, the heater bare wires are each a copper alloy wire containing therein silver. As a result of this, the heater bare wire can have a tensile strength two or three times as high as that of a soft copper wire. Therefore, the heater bare wire can be made thin and highly flexible.

Also, according to the invention, there is provided a reticulate heater in which, preferably, electrodes are connected to both end portions of the net-mesh-like-structured heat generator as viewed in the vertical direction in a state of their being disposed isolated from each other; and each of the electrodes consists of electrically conductive tapes and electrically conductive adhesive for causing the electrically conductive tapes to respectively adhere to an obverse and reverse surface of the net-mesh-like-structured heat generator. As a result of this, the net-mesh-like-structured heat generator can be made up into a parallel circuit. Therefore, the resistance value thereof becomes very stable.

Also, in the reticulate heater of the invention, preferably, electrodes are connected to both end portions of the net-mesh-like-structured heat generator as viewed in the vertical direction in a state of their being disposed isolated from each other, and the electrodes have two metal foils each having a predetermined width and length and having a thickness of from 0.01 mm to 0.5 mm, whereby the electrodes are prepared by the both end portions of the net-mesh-like-structured heat generator being individually superposed on and welded to the two metal foils. According to this electrode portion, it is possible to make the metal foil thin and therefore to prevent the electrode itself from having its flexibility impaired. Also, as this metal foil, it is possible to use a type having electrical conductivity and corrosion resistance. Therefore, it is possible to prevent the electrode from deteriorating with age due to the oxidation. Further, the metal foil and the net-mesh-like-structured heat generator are fixed together by welding. Therefore, it is possible to prevent the resulting heat generator from having its breaking strength inconveniently decreased.

Also, in the reticulate heater of the invention, preferably, the metal foil is film-processed by non-ferrous metal having electrical conductivity and corrosion resistance. Also, in the reticulate heater of the invention, non-ferrous metal having electrical conductivity and corrosion resistance is used as the material of the metal foil. According to these metal foils, it is possible to prevent the surface from being oxidized during the use of the heater.

Also, in the reticulate heater of the invention, preferably, the welding between the metal foils and the both end portions of the net-mesh-like-structured heat generator is performed by soldering. According to this soldering, a film of coating can be formed over the entire surface of the metal foil, on which the net-mesh-like-structured heat generator has been superposed, and to a thickness smaller than that of the metal foil. Therefore, it is possible to prevent the flexibility of the electrode itself and also to prevent the breaking strength from being decreased in the electrode portion.

BRIEF DESCRIPTION OF THE DRAWINGS

FIG. 2A is a view illustrating the size of the reticulate heater and FIG. 2B is a view illustrating a state where the reticulate heater is made up into a parallel circuit;

FIG. 7A is a pattern view illustrating the pattern of a tricot knitting and FIG. 7B is a sectional view illustrating the heater wire.

DESCRIPTION OF THE PREFERRED EMBODIMENTS

A reticulate heater according to a preferred embodiment of the present invention will hereafter be explained with reference to the drawings.

Figure 1:
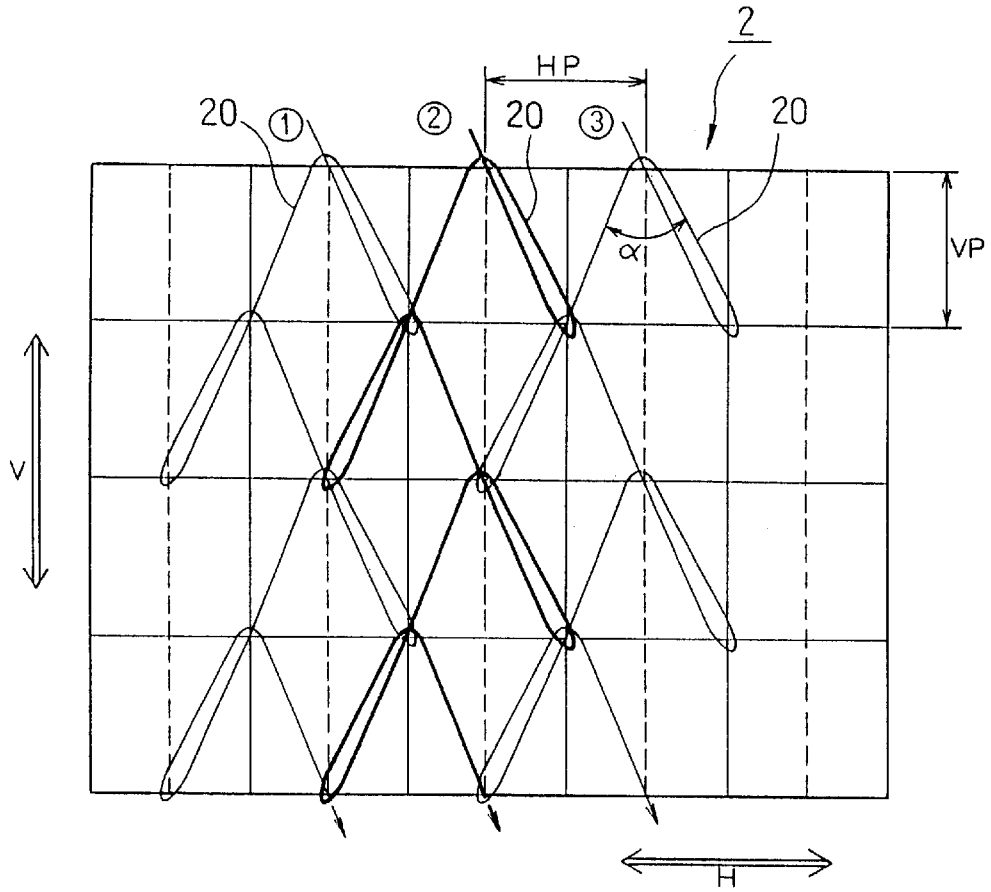
FIG. 1 is a pattern view illustrating the pattern of a tricot knitting in a reticulate heater according to a preferred embodiment of the present invention.

As illustrated in FIG. 1, a reticulate heater of the invention has a net-mesh-like-structured heat generator 2 that is formed by performing tricot knitting of a plurality of heater wires 20 each having the same diameter. Here, the "tricot knitting" is defined to mean the way of knitting in which loops are vertically formed by vertically knitting a heater wire on a continuous and planar basis. The material of the heater wire 20 of the net-mesh-like-structured heat generator 2, preferably, is a copper alloy containing therein 1% or more of nickel, or an alloy such as that constituting a nichrome wire, which has high corrosion resistance and whose resistance value is easy to control. Also, in case that alloy has a volume resistivity 1 to 100 times, preferably 2 to 20 times, as high as that of pure copper, the workability thereof becomes good. Further, in case that the diameter of the heater wire 20 is from 0.02 to 0.12 mm, preferably from 0.06 to 0.08 mm, the mechanical strength and the flexibility thereof can be made compatible with each other.

It is to be noted that in case the diameter of the heater wire 20 is made to be 0.02 to 0.04 mm, the heater wire made of the above-described material becomes weak in terms of the tensile strength. Therefore, the heater wire preferably is a copper alloy wire containing therein silver. This copper alloy wire containing therein silver can, according to the content of silver, have a tensile strength 2 to 3 times as high as that of a soft copper wire. Therefore, even when this copper alloy wire containing therein silver is made to have a diameter of 0.04 mm, the tensile strength thereof can be made almost the same as the tensile strength of the copper alloy wire containing therein 1% or more of nickel and having a diameter of 0.05 to 0.07 mm. Accordingly, this copper alloy wire containing therein silver becomes able to provide the heater wire 20 smaller in thickness and higher in flexibility. Therefore, it becomes possible to further enhance the elasticity and flexibility of the reticulate heater.

The pitch of the knit meshes when tricot knitting the above-described heater wire 20 to form the heat generator 2 may be from 0.5 to 5 mm, preferably from 1 to 3 mm. If so, the resulting heat generator 2 can satisfy all required levels of the evenness of the generated-heat, the workability, and the economicalness. Assume that, for example, the vertical pitch VP is 1 mm; and the apex angle α of one knit-mesh is 60°. Then, the actual vertical length of the heater wire 20 corresponding to a vertical 4-mesh measure falling upon the same horizontal 1-mesh measure is expressed as below. Provided, however, that it is here assumed that that length corresponds to a 4-mesh measure of the length of an entire imaginary vertical heater wire in the vertical direction V.

$$\frac{1\times\cos^{-1}30^\circ\times 2}{1\times 4} = 3.46 \text{ times} \tag{1}$$

Accordingly, assuming that the intersecting portions of the heater wire 20 make no mutual contact at their intersecting position (hereinafter referred to as "the intersection"), the resistance value of the heater wire 20 is 3.46 times as great as that of the heater wire 20 having a simple measured length.

Figure 2:
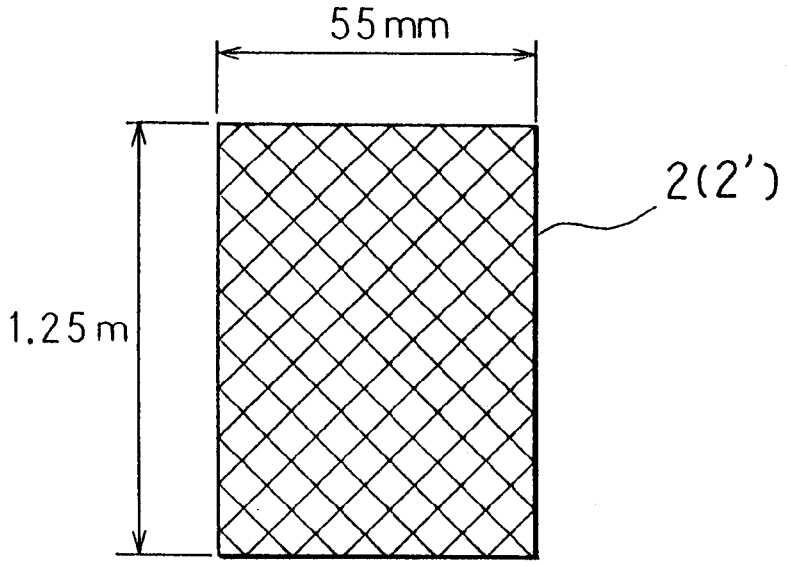
FIGS. 2A and 2B are views illustrating the reticulate heater of the invention.
Figure 2:
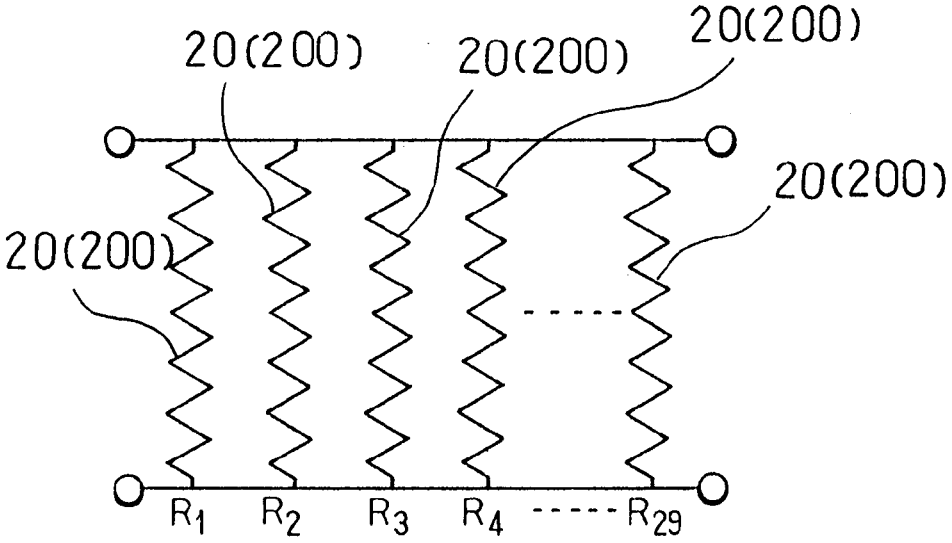

Also, assume that as illustrated in FIGS. 2A and 2B the net-mesh-like-structured heat generator 2 has a rectangular shape 55 mm in width and 1.25 m in length; and 29 pieces of the vertical heater wire 20 be disposed in the width direction of the heat generator 2. Then, the horizontal pitch HP is expressed as follows.

$$\frac{55}{29} \approx 1.9 \text{ mm} \tag{2}$$

Therefore, assuming that the intersecting portions of all the vertical heater wires 20 make completely no mutual contact at all of their intersections, the heat generator 2 becomes a parallel circuit comprising 29 pieces of the vertical heater wire 20. And, in this case, one piece of the vertical heater wire 20 has a resistance value of 1.25 m×3.46. Here, assume that an alloy wire having a diameter of 0.06 mm and a volume resistivity value of 54Ω/m be used as the heater wire 20. Then, because the resistance per meter of the net-mesh-like-structured heat generator 2 is expressed as follows.

$$\frac{1}{R} = \frac{1}{R_1} + \frac{1}{R_2} \cdots + \frac{1}{R_{29}} \tag{3}$$

$$R = \frac{54}{29}$$

Therefore, the resistance R of the net-mesh-like-structured heat generator 2 is expressed as follows.

$$R = 1.25 \text{ m}\times 3.46\times\frac{54}{29} \tag{4}$$

$$= 8.05$$

Accordingly, the maximum resistance value that is obtained when the intersecting portions of the net-mesh-like-structured heat generator 2 make completely no mutual contact at any one of their intersections is approximately 8Ω.

Figure 3:
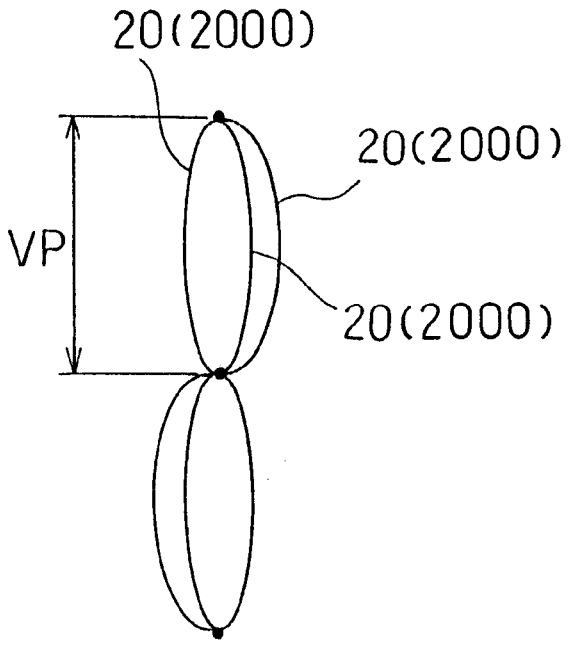
FIG. 3 is a view illustrating a state of the heater wire that prevails when the heater wires are contacted together at all intersecting points of the net-mesh-like-structured heat generator used in the reticulate heater of the invention.

On the other hand, assume that the intersecting portions of the net-mesh-like-structured heat generator 2 make their mutual contact at all of their intersections. Then, in case that the vertical pitch VP is 1 mm, it results that the vertical heater wire 20 having a length of $1\times\cos^{-1}30^\circ$ with respect to this basic length VP equally exists three pieces in number in any one-mesh measure. Therefore, the net-mesh-like-structured heat generator 2 can be modeled into a simple parallel circuit such as that illustrated in FIG. 3. As a result of this, the resistance R of the net-mesh-like-structured heat generator 2 is expressed as follows.

$$\frac{1}{R} = \frac{1}{1.25} + \frac{1}{1.25} + \frac{1}{1.25} \tag{5}$$

$$R \approx 0.42$$

$$R = 8.05\times 0.42 \approx 3.35\Omega \tag{6}$$

From these matters, it becomes possible to stabilize the resistance value of the net-mesh-like-structured heat generator 2.

Incidentally, in case that having used a non-annealed hard wire as the material of the heater wire 20 the net-mesh-like-structured heat generator 2 becomes likely to rise at the intersection. Therefore, when measuring the resistance value in a natural state where the generator 2 is horizontally laid, the resistance value comes near to the maximum resistance value. Conversely, in case that having used a sufficiently annealed soft wire, the points of contact in the intersections of the heater wires 20 increase. Therefore, the resistance value comes near to the minimum resistance value.

In this way, if regularly knitting a plurality of the heater wires 20 so that the resulting loops may continue in the vertical direction, the effect of the local breakage of the wires, the effect of the intersections, etc. become lessened. It thereby becomes possible to provide the reticulate heater 1 that is also high in elasticity in addition.

Figure 4:
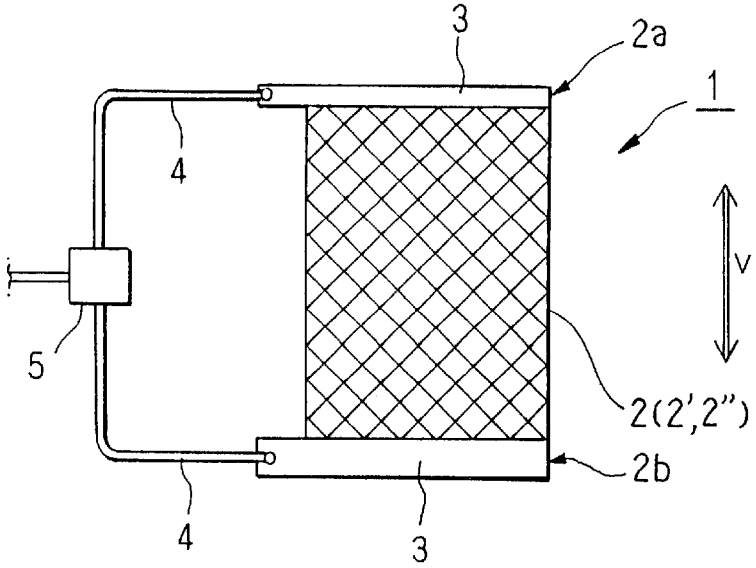
FIG. 4 is a view illustrating the entire construction of the reticulate heater according to the preferred embodiment of the invention.
Figure 5:
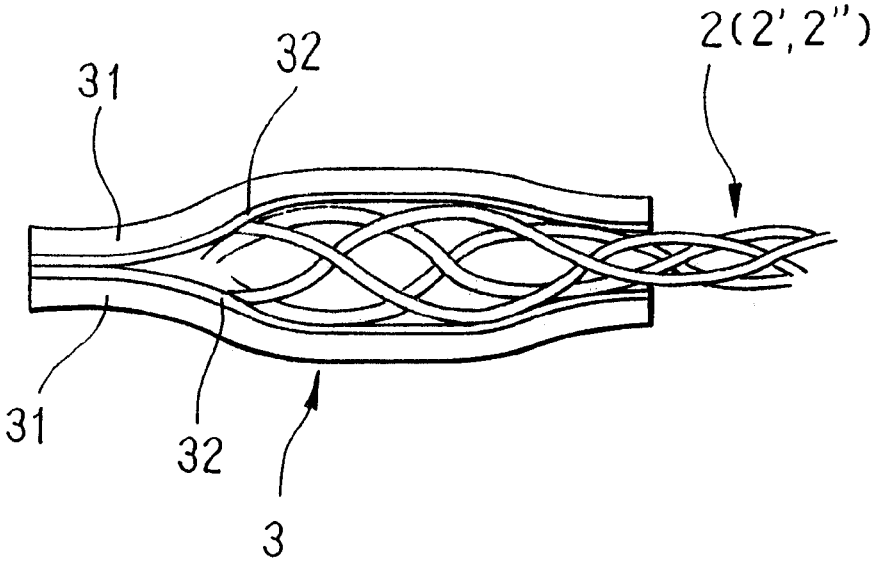
FIG. 5 is a view, partly in section, that illustrates a state where adherence is made between electrodes and the net-mesh-like-structured heat generator for use in the reticulate heater of the invention.

Also, as illustrated in FIG. 4, to both end portions 2*a* and 2*b* in the vertical direction V of the net-mesh-like-structured heat generator 2 having been formed by the tricot knitting technique there are connected electrodes 3 and 3 in a state of their being disposed isolated from each other. Each of these electrodes 3 is used for bringing the net-mesh-like-structured heat generator 2 to an electrically stable state. To this end, the electrode 3 covers the entire width of a corresponding one of the both end portions 2*a* and 2*b* in the vertical direction V of the net-mesh-like-structured heat generator 2. As illustrated in FIG. 5, the electrode 3 is comprised of a conductive tape 31 and a conductive adhesive 32 for causing the conductive tape 31 to cohere to an obverse and a reverse surface of the net-mesh-like-structured heat generator 2. The conductive tape 31, preferably, is a copper foil tape having a thickness of 30 μm or so, an aluminum Mylar tape unlikely to rust and having a thickness capable of providing a proper electric capacity, or the like. Also, the conductive adhesive 32, preferably, is the one wherein conductive carbon is blended into silicone-rubber adhesive, or the like. As a result of this, it is possible to make up the net-mesh-like-structured heat generator 2 into a parallel circuit. Therefore, the resistance value thereof is stabilized very much. To the end portions of these two electrodes 3 and 3 there are respectively connected lead wires 4 and 4, which are connected to a thermostat 5.

Incidentally, it may be arranged that braided wires or strand assembled wires be made to follow each of the both end portions 2*a* and 2*b* in the vertical direction V of the net-mesh-like-structured heat generator 2. And it may be arranged that the intersecting portions at which those braided wires or strand assembled wires make their mutual contact be locally soldered together. If doing so, and if the amount of solder is small and the knit mesh is large in size, the flexibility of the resulting net-mesh-like-structured heat generator 2 is not impaired.

Figure 6:
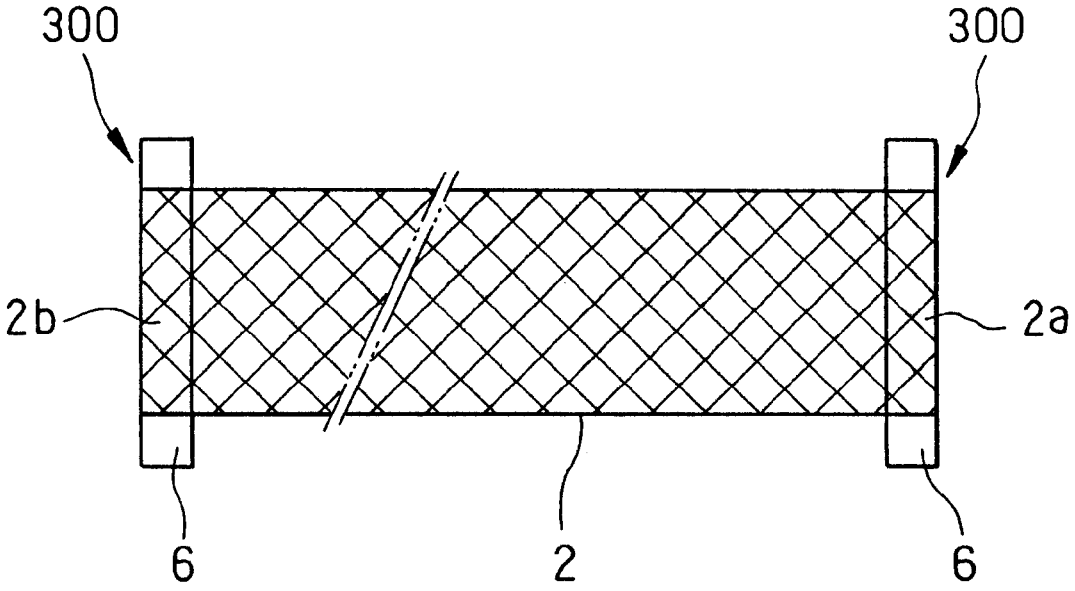
FIG. 6 is a view illustrating an example of the electrode of the reticulate heater of the invention.

Also, as illustrated in FIG. 6, the electrodes may have two pieces of metal foils 6, 6 each having a predetermined width and length and a thickness of from 0.01 mm to 0.5 mm. And the electrodes may thereby be the one wherein the both end portions 2*a*, 2*b* in the vertical direction V of the net-mesh-like-structured heat generator 2 are individually superposed on and welded to such metal foils 6, 6. In order to maintain the flexibility to an extent as large as possible, preferably, the thickness of the metal foil 6 is from 0.01 mm to 0.2 mm. If the thickness is within this range, it is possible to prevent the heater from generating heat to an extent larger than necessary. In addition, nor does the mechanical strength become deteriorated.

The metal foil 6 preferably is the one wherein non-ferrous metal such as tin, solder, or gold having electrical conductivity and corrosion resistance is film-processed by plating or the like. As a result of this film processing, it is possible to prevent the surface of the metal foil 6 from being oxidized during the use of the heater. It is to be noted that even when the metal foil 6 itself is made of non-ferrous metal such as gold, silver, or nickel having electrical conductivity and corrosion resistance, the same effect can be obtained. Also, as the method of welding between the metal foils 6, 6 and the both end portions 2*a*, 2*b* of the net-mesh-like-structured heat generator 2, soldering, spot welding, or laser welding is suitably used. Especially, in case of soldering, a film of coating can be formed over the entire surface of the metal foil 6 having superposed thereon the net-mesh-like-structured heat generator 2 and to a thickness smaller than that of the metal foil 6 (the thickness of 5$\mu$ to 30$\mu$ is preferable). Therefore, it is possible to prevent the impairment of the flexibility of the electrode 300 and in addition to prevent the decrease in the breaking strength of the electrode portion. Additionally, in case of spot welding or laser welding, it becomes necessary to take measures such as to weld in an atmosphere of inert gas or alternatively to use the metal foil 6 made of noble metal, in order to prevent the oxidation of the metal foil 6 due to a high-temperature heat at the time of the working.

Concerning the net-mesh-like-structured heat generator 2 wherein the electrode 300 using such metal foil 6 is connected to each of the both end portions 2*a*, 2*b*, the following experiments were conducted thereon.

The contents of the experiments are the breaking tests on the net-mesh-like-structured heat generator 2 wherein the electrode 300 using the metal foil 6 is connected to each of the both end portions 2*a*, 2*b*. The breaking strength was examined by pulling the electrodes 300, 300 connected to the both end portions 2*a*, 2*b* of the net-mesh-like-structured heat generator 2 by a tensile tester in mutually opposite directions.

As the samples of this tensile tests there were prepared the following three kinds of samples.

(1) The sample wherein selective determination is made of the net-mesh-like-structured heat generator formed of the heater wires each consisting of only a heater bare wire alone having a diameter of approximately 0.07 mm and made of copper alloy and a tin-plated copper foil 7 mm wide, 80 mm long, and 0.1 mm thick; and these two elements are connected together by the use of an ordinary solder that is a Sn—Pb alloy containing therein 63% of tin and with the use of a solder trowel heated up to 320° C. to 350° C.

(2) The sample wherein selective determination is made of the net-mesh-like-structured heat generator formed of the heater wires each consisting of only a heater bare wire alone having a diameter of approximately 0.07 mm and made of copper alloy and a pure-copper foil 8 mm wide, 80 mm long, and 0.03 mm thick; and these two elements are connected together by the use of an ordinary solder that is a Sn—Pb alloy containing therein 63% of tin and with the use of a solder trowel heated up to 320° C. to 350° C.

(3) The sample wherein selective determination is made of the net-mesh-like-structured heat generator formed of the heater wires, each consisting of a heater bare wire having a diameter of approximately 0.07 mm and made of copper alloy and insulation-coated with JIS 3rd kind urethane, and a tin-plated copper foil 7 mm wide, 80 mm long, and 0.1 mm thick; and these two elements are connected together by the use of an ordinary solder that is a Sn—Pb alloy containing therein 63% of tin and with the use of a solder trowel heated up to 350° C. to 400° C.

Tensile test was conducted on each of these three kinds of samples by the use of the tensile tester. As a result, every one of the samples was broken at other portions than the electrodes. Therefore, it could be confirmed that the breaking strength substantially the same as that of the heater wire itself was obtained.

In this way, according to the net-mesh-like-structured heat generator 2 wherein the electrode 300 using the metal foil 6 is connected to each of the both end portions 2*a*, 2*b*, it is possible to make the metal foil 6 thin. Therefore, it is possible to prevent the flexibility of the electrode itself from being impaired. Also, as the metal foil 6 it is possible to use the one having electrical conductivity and corrosion resistance. Therefore, it is possible to prevent the deterioration with age due to the oxidation. Also, since the metal foil 6 and the net-mesh-like-structured heat generator 2 can be fixed together by soldering, the breaking strength can be prevented from being decreased at the electrode portion.

Incidentally, the electrode may be also attached as follows. Namely, the both end portions of the net-mesh-like-structured heat generator are bent each, and each bent one of the both end portions is made to clamp the metal foil between its bent portions, whereby the metal foil and the end portion are welded together.

Also, when covering insulating material onto the heater wire of the net-mesh-like-structured heat generator 2 as in the case of the above-described sample (3), the following methods can be considered as being available for insulation. (1) As the steps executed beforehand, a self-welding rubber tape, a vinyl tape, or the like is turned around, or bonded onto, a member to be work-executed. The reticulate heater 1 is bonded onto the resulting member. The tape is further wound around over the resulting member. (2) The net-mesh-like-structured heat generator 2 itself of the reticulate heater 1 is immersed in a liquid silicone rubber, a fluorine resin dispersion solution, or the like, and the reticulate heater 1 is thereby covered with the resulting film having a prescribed small thickness, beforehand. (3) The net-mesh-like-structured heat generator 2 is clamped using a for-use-in-laminate film made of PE—PET (polyethylene-polyethylene telephthalate) material, based on the use of PE (polyethylene) and having a low softening point and being relatively easily thermal-fused, or the like. And the resulting heat generator 2 is thermal-fused beforehand. In any one of these methods, the net-mesh-like-structured heat generator 2 must be handled so that the flexibility thereof will not be impaired.

Figure 7:
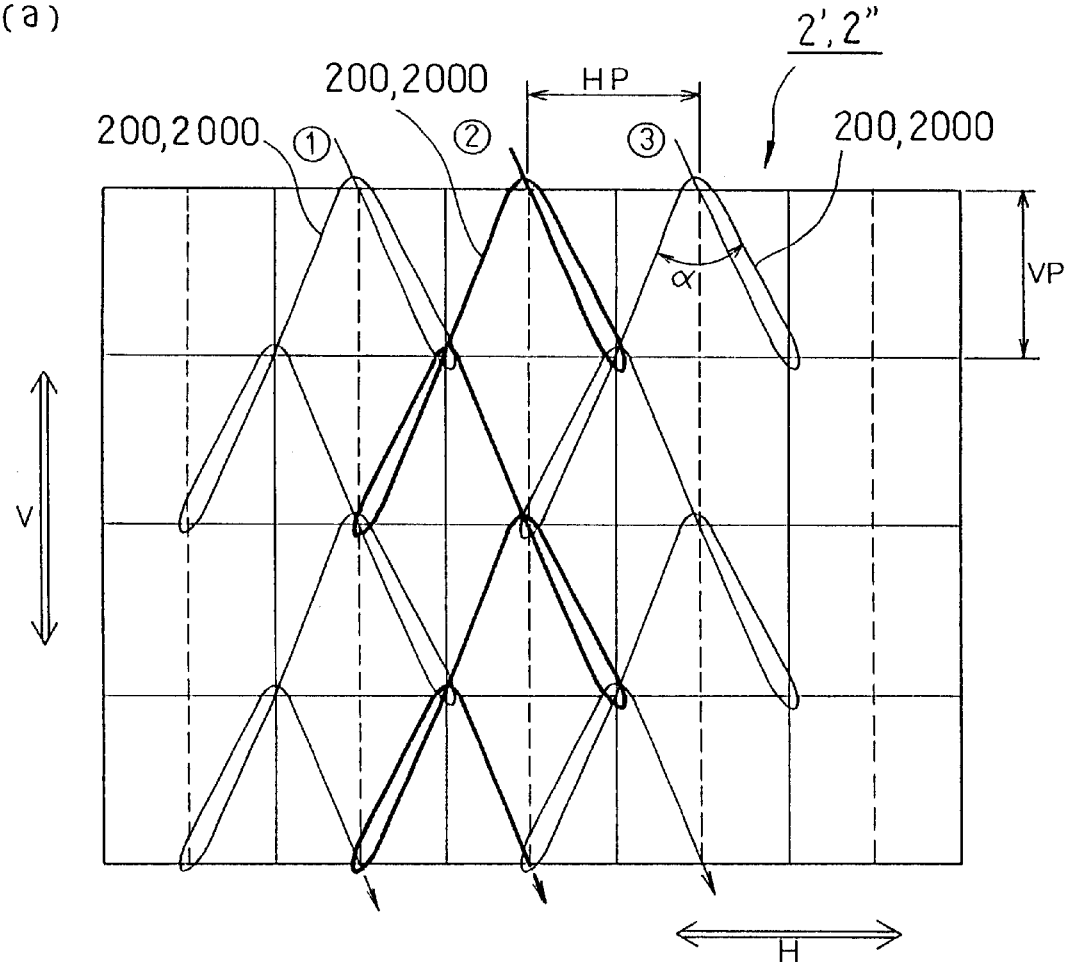
FIGS. 7A and 7B are views illustrating a reticulate heater according to another preferred embodiment of the invention.
Figure 7:
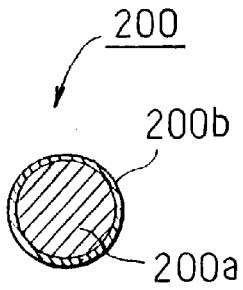

Incidentally, in the foregoing description, as the preferred embodiment of the reticulate heater according to the invention, the net-mesh-like-structured heat generator 2 has been formed by tricot knitting being performed of the heater wires 20 each consisting of a heater bare wire only. However, the invention is not limited thereto. Namely, as illustrated in FIGS. 7A and 7B, a plurality of heater wires 200 each prepared by covering a heater bare wire 200*a* having one and the same diameter with a for-enamel-wire coating 200*b* may be prepared. And these heater wires 200 may be tricot knitted, thereby a net-mesh-like-structured heat generator 2' may be formed. As the material of the heater bare wire 200*a* of the heater wire 200 used in the net-mesh-like-structured heat generator 2' there is used the same kind of material as that constituting the heater wire 20 of the net-mesh-like-structured heat generator 2. The same effect as that attainable with this material can be obtained.

The for-enamel-wire coating 200*b* is coated and printed onto the heater bare wire 200*a*, thereby an insulating film is formed. This for-enamel-wire coating 200*b*, preferably, is the one having polyvinyl acetal, polyurethane, polyamideimide, or polyimide as the main component. The for-enamel-wire coating having polyvinyl acetal or polyurethane as the main component has a resistance to heat having a temperature of from 100 to 150° C. and soldering can be performed with no coating film being peeled away. Therefore, the heater wire with this for-enamel-wire coating has higher reliability while, on the other hand, such heater wire enables the construction of the electrodes in a short time. Also, the for-enamel-wire coating having polyamide-imide or polyimide as the main component has a high resistance to heat and also a high resistance to wear. Therefore, the heater wire with this for-enamel-wire coating becomes easier to tricot knit. According to the use of such kinds of for-enamel-wire coating, the following advantages are brought about. (1) It is possible to ensure a required level of insulation with a very thin and uniform-in-thickness coating film. For example, in case of a metal conductor having a diameter of 0.07 mm, if using a coating for use on a JIS 3rd class enamel wire, the metal conductor has a minimum coating-film thickness of 0.003 mm. Therefore, the outside diameter of the resulting heater wire does not become larger than needed. (2) The for-enamel-wire coating can resist severe mechanical bending when the resulting heater wire is knitted in. And (3) according to the necessity, it is possible to select a heat-resisting clade from over a wide range thereof. Namely, except for specific use purposes, it becomes possible to select from among the clades, under the UL standard, ranging from 105 to 240° C.

Incidentally, as the insulating film for use on the heater bare wire, it is also considered to use a paper roll, a silk roll, or thermoplastic resin such as polyethylene or vinyl chloride. However, in case of a paper roll or a silk roll, the slidability of the surface becomes deteriorated. Therefore, when knitting the resulting heater wire in, this wire is caused to get frayed or get broken. In addition, the wire becomes enlarged in outside diameter. Further, in case of thermoplastic resin, also, the slidability of the surface becomes deteriorated. Therefore, it becomes impossible to perform tricot knitting. In addition, the thickness of the insulating film becomes much larger than that of the insulating film of the for-enamel-wire coating. Therefore, the efficiency of the thermal conduction becomes low.

As in the case of the above-described net-mesh-like-structured heat generator 2, the knit-mesh pitch when tricot knitting such heater wire 200 to thereby form the heat generator may be from 0.5 to 5 mm, preferably from 1 to 3 mm. If the knit-mesh pitch is as such, the resulting heat generator can satisfy all required levels of the evenness of the generated heat, the workability, and the economicalness. Assume that, for example, the vertical pitch VP is 1 mm; and the apex angle $\alpha$ of one knit-mesh is 60°. Then, the actual vertical length of the heater wire 200 corresponding to a vertical 4-mesh measure falling upon the same horizontal 1-mesh measure becomes 3.46 times greater. Accordingly, because the intersecting portions of the heater bare wires 200*a* of the heater wire 200 make no mutual contact at all of their intersections, the resistance value of the heater wire 200 becomes 3.46 times as great as that of the heater wire 200 having a simple measured length.

Also, as illustrated in FIGS. 2A and 2B, the net-mesh-like-structured heat generator 2' has a rectangular shape 55 mm in width and 1.25 m in length, and 29 pieces of the vertical heater wire 200 are disposed in the width direction of the heat generator 2. It is seen from this that the resistance value of the net-mesh-like-structured heat generator 2' can be stabilized.

Incidentally, the above-described net-mesh-like-structured heat generator 2' has been the one that is formed using a plurality of the heater wires 200 only each prepared by covering the heater bare wire 200*a* with the enamel coating 200*b*. However, the invention is not limited thereto. The net-mesh-like-structured heat generator of the invention may comprise a plurality of first heater wires 2000 each consisting of a heater bare wire only and a plurality of second heater wires 200 each consisting of the heater bare wire 200*a* coated with the enamel coating 200*b*. In this case, the net-mesh-like-structured heat generator is the one 2" that is formed by the first heater wires 2000 and the second heater wires 200 being tricot knitted such that the loops are vertically continuously formed on a planar basis.

Also, in that case, knitting is performed of the first and second heater wires so that fellow ones of the first heater wires 2000 will not intersect each other. As a result of this, the intersecting portions of the heater wires can be reliably insulated at their relevant intersection from each other by the for-enamel-wire coating. Therefore, it is possible to stabilize the resistance value of such net-mesh-like-structured heat generator 2". Also, it is, for example, possible to alternately knit the first heater wire 2000 and the second heater wire 200 in. By doing so, it is possible to increase the proportion of the first heater wires 2000 each consisting of only the heater bare wire, the unit price of that is low. By doing so, when performing mass-production, it becomes possible to achieve the reduction in the cost.

Further, as a preferred embodiment of the reticulate heater of the invention, the net-mesh-like-structured heat generator 2" wherein a plurality of the heater bare wires 2000 are tricot knitted and which is thereby formed, itself, may be insulation processed, beforehand.

As such insulation processing, it is considered to perform oxide film formation through heating or to perform application of the insulation coating or insulative oil. The oxide film made through heating can be formed as follows. For example, in case that the heater bare wire is made of a copper alloy containing therein 1% or more of nickel, an electrode is connected to the net-mesh-like-structured heat generator 2" formed by the heater bare wires 2000 being tricot knitted, beforehand. Then, the temperature of the heat generated therefrom is set to be 200° C., and the resulting mass is heated for one hour. As a result of this, the oxide film can be formed. Also, the application of the insulation coating is performed as follows. The insulation coating such as urethane coating, acryl coating, epoxy coating, or fluorine resin coating is applied to the net-mesh-like-structured heat generator 2" formed by the heater bare wires 2000 being tricot knitted, beforehand. Thereafter, the insulation coating is printed onto the heat generator 2" to thereby form a coating film. The application of the insulative oil is performed as follows. Namely, the insulative oil such as silicone oil is applied in small amount to thereby form a coating film. In the application of any one of the coating materials, insulation processing must be performed so as not to remarkably impair the flexibility of the net-mesh-like-structured heat generator 2.

Assume here that the heater bare wires 2000 of the net-mesh-like-structured heat generator 2" make their mutual contact at all of their intersections. Then, in case that the vertical pitch VP is 1 mm, it results that the vertical heater bare wire 2000 having a length of $1\times\cos^{-1} 30°$ with respect to this basic length VP equally exists three pieces in number in any one-mesh measure. Therefore, the net-mesh-like-structured heat generator 2" can be modeled into a simple parallel circuit such as that illustrated in FIG. 3. As a result of this, the resistance R of the net-mesh-like-structured heat generator 2" is expressed as follows.

$$\frac{1}{R} = \frac{1}{1.25} + \frac{1}{1.25} + \frac{1}{1.25} \tag{5}$$

$$R \approx 0.42$$

$$R=8.05\times0.42\approx3.35\Omega \tag{6}$$

From this, it is seen that the resistance value of the net-mesh-like-structured heat generator 2" can be stabilized.

Incidentally, in case that having used a non-annealed hard wire as the material of the heater bare wire 2000, the net-mesh-like-structured heat generator 2" becomes likely to rise at the intersection. Therefore, when measuring the resistance value in a natural state where the generator 2" is horizontally laid, the resistance value comes near to the maximum resistance value. Conversely, in case that having used a sufficiently annealed soft wire, the points of contact in the intersections of the heater wires 20 increase. Therefore, the resistance value comes near to the minimum resistance value.

In this way, if regularly knitting a plurality of the heater wires 200 or heater bare wires 2000 so that the resulting loops may continue in the vertical direction, the effect of the local breakage of the wires, the effect of the intersections, etc. become lessened. It thereby becomes possible to provide the reticulate heater 1 that is also high in elasticity in addition. As a result of this, in the intersection of the heater wires 200 or the heater bare wires 2000, no rise occurs in these wires 200 or 2000.

Also, as in the case of the net-mesh-like-structured heat generator 2, to both end portions 2*a* and 2*b* in the vertical direction V of the net-mesh-like-structured heat generator 2' (2") having been formed by the tricot knitting technique there are connected the electrodes 3 and 3 in a state of their being disposed isolated from each other. Each of these electrodes 3 is used for bringing the net-mesh-like-structured heat generator 2' (2") to an electrically stable state. To this end, the electrode 3 covers the entire width of a corresponding one of the both end portions 2*a* and 2*b* in the vertical direction V of the net-mesh-like-structured heat generator 2' (2") (FIG. 4). As in the case of the net-mesh-like-structured heat generator 2, this electrode 3 is comprised of a conductive tape 31 and a conductive adhesive 32 for causing the conductive tape 31 to cohere to an obverse and a reverse surface of the net-mesh-like-structured heat generator 2' (2"). The net-mesh-like-structured heat generator 2' (2") can have the same effect as that attainable with the net-mesh-like-structured heat generator 2.

Each of the above-described reticulate heaters is ordinarily knitted with a warp-knitting machine.

EXAMPLE

Next, comparison experiments on the DC resistance value were conducted between the reticulate heater of the invention having the net-mesh-like-structured heat generator formed by tricot knitting and a reticulate heater having a net-mesh-like-structured heat generator formed by horizontal hosiery knitting, under the following conditions.

EXAMPLE 1

For the reticulate heater of the invention having the net-mesh-like-structured heat generator formed by tricot knitting, use is made of the heater wires (heater bare wires) each having a diameter of 0.06 mm and a volume resistivity value approximately 10 times as great as that of pure copper. Also, the resulting net-mesh-like-structured heat generator has a rectangular configuration, the vertical pitch, the horizontal pitch, the width, and the length of that are respectively set to be 3 mm, 2 mm, 60 mm, and 1200 mm.

COMPARATIVE EXAMPLE 1

For the reticulate heater having the net-mesh-like-structured heat generator formed by horizontal hosiery knitting (a for-stocking circular knitting technique), use is made of the heater wires each having a diameter of 0.06 mm and a volume resistivity value approximately 10 times as great as that of pure copper. Also, the resulting net-mesh-like-structured heat generator has a rectangular configuration, the width and the length of that are respectively set to be 70 mm and 1000 mm.

The comparison results are as follows. In the Example 1, the DC resistance value falls within a range of 5Ω±5%, and there was no abnormality in terms of the flexibility even when the heater was drawn 20 percent. In contrast to this, in the Comparative Example 1, the DC resistance value is 0.5Ω, is approximately 10Ω when the heater was in a natural state of being horizontally laid, and is approximately 10KΩ when the heater was contracted 10 percent in the longitudinal direction. It was proved that the DC resistance value varied over a range as wide as up to even four digits. Also, the horizontal hosiery knitting of the Comparative Example 1 is the one formed by horizontally performing knitting stage by stage using a single piece of heater wire. Therefore, when the wire is partly broken, the DC resistance value becomes inconveniently large.

Further, the reticulate heater used in the Example 1 was wound onto an entire mimic handle, and further a vinyl tape was stop wound onto the resulting handle. Then, the DC resistance value was measured. The result is approximately 3.5Ω. It could be confirmed from this that even when winding the reticulate heater onto the handle the resistance value was very stable.

As has been explained above, according to the reticulate heater of the invention, the reticulate heater is formed by tricot knitting a plurality of the heater wires each consisting of only a heater bare wire. Therefore, the reticulate heater has high elasticity and flexibility. Therefore, the reticulate heater can be close adhered even to a complex curved surface as well.

Also, according to the reticulate heater of the invention, the reticulate heater is formed by tricot knitting a plurality of heater wires each prepared by covering a heater bare wire with a for-enamel-wire coating. Or, the reticulate heater is formed by tricot knitting a plurality of first heater wires each consisting of a heater bare wire only and a plurality of second heater wires each prepared by covering the heater bare wire with a for-enamel-wire coating. Therefore, the reticulate heater has high elasticity and flexibility. Therefore, the reticulate heater can be close adhered even to a complex curved surface as well. In addition, the heater bare wires are insulated using an insulator so that fellow ones of these heater bare wires will not intersect each other. Therefore, the resistance value of the reticulate heater can be made stable. As a result of this, it becomes possible to obtain a stable constant amount of heat generated.

Also, according to the reticulate heater of the invention, the reticulate heater is formed by tricot knitting a plurality of the heater wires each consisting of only a heater bare wire. In addition, each of these heater wires is insulation processed. Therefore, the reticulate heater has high elasticity and flexibility. Therefore, the reticulate heater can be close adhered even to a complex curved surface as well. In addition, the net-mesh-like-structured heat generator formed using the heater bare wires only, itself, is covered with an insulator. Therefore, the resistance value of the reticulate heater can be made stable. As a result of this, it becomes possible to obtain a stable constant amount of heat generated.

Further, according to the reticulate heater of the invention, as the electrode portion, use is made of the structure wherein the metal foils are welded to the both end portions of the net-mesh-like-structured heat generator. By this use, it is possible to prevent the flexibility of the electrode itself from being impaired and in addition to prevent the breaking strength from being decreased at the electrode portion. Also, if using the metal foil having electrical conductivity and corrosion resistance, it is possible to prevent the deterioration with age due to the oxidation.

Even when used on the handle or seat of an automobile, each of these reticulate heaters is electrically stabilized. Therefore, the reticulate heater can be made to rise in temperature in a short time. Especially, in the handle of an automobile, the heater wires do not rise at the position where these heater wires intersect each other. Therefore, those heater wires do not come up to the surface covering for covering the surface of the heater. Also, the reticulate heater can be used on an elbow portion of complex piping, too. Since the reticulate heater can be made to rise in temperature in a short time, the reticulate heater can also serve to ensure the flowability of water in a severe winter season.

What is claimed is:

1. A reticulate heater comprising:

a net-mesh-like-structured heat generator including a plurality of heater wires each having the same wire diameter of from 0.02 to 0.12 mm, the plurality of heater wires being formed into the net-mesh-like-structured heat generator by a tricot knitting technique wherein loops are vertically formed by vertically knitting the heater wire on a continuous and planar basis, the knit meshes of the tricot knitting having a pitch of 0.5 to 5 mm.

2. A reticulate heater comprising:

a net-mesh-like-structured heat generator including a plurality of heater wires each having the same wire diameter of from 0.02 to 0.12 mm and prepared by covering a heater bare wire with a for-enamel-wire coating, the plurality of heater wires being formed into the net-mesh-like-structured heat generator by a tricot knitting technique wherein loops are vertically formed by vertically knitting the heater wire on a continuous and planar basis, the knit meshes of the tricot knitting having a pitch of 0.5 to 5 mm.

3. A reticulate heater comprising:

a net-mesh-like-structured heat generator including a plurality of first heater wires each having the same wire diameter of from 0.02 to 0.12 mm and consisting of a heater bare wire only and a plurality of second heater wires each prepared by covering the heater bare wire with a for-enamel-wire coating, the plurality of first heater wires and second heater wires being formed into the net-mesh-like-structured heat generator by a tricot knitting technique wherein loops are vertically formed by vertically knitting the first and second heater wires on a continuous and planar basis so that fellow ones of the first heater wires will not intersect each other, the knit meshes of the tricot knitting having a pitch of 0.5 to 5 mm.

4. A reticulate heater comprising:

a net-mesh-like-structured heat generator including a plurality of heater bare wires each having the same wire diameter of from 0.02 to 0.12 mm, the plurality of heater bare wires being formed into the net-mesh-like-structured heat generator by a tricot knitting technique wherein loops are vertically formed by vertically braiding the heater wire on a continuous and planar basis, the knit meshes of the tricot knitting having a pitch of 0.5 to 5 mm, the plurality of heater bare wires that are formed into the net-mesh-like-structured heat generator by a tricot knitting technique being insulation processed.

5. A reticulate heater as set forth in claim 1, wherein the heater bare wires are each a copper alloy wire containing therein silver.

6. A reticulate heater as set forth in claim 1 wherein electrodes are connected to both end portions of the net-mesh-like-structured heat generator as viewed in the vertical direction in a state of their being disposed isolated from each other; and each of the electrodes consist of electrically conductive tapes and electrically conductive adhesive for causing the electrically conductive tapes to respectively adhere to an obverse and reverse surface of the net-mesh-like-structured heat generator.

7. A recitulate heater as set forth in claim 1, wherein electrodes are connected to both end portions of the net-mesh-like-structured heat generator as viewed in the vertical direction in a state of their being disposed isolated from each other; and the electrodes have two metal foils each having a predetermined width and length and having a thickness of from 0.01 mm to 0.5 mm, whereby the electrodes are prepared by the both end portions of the net-mesh-like-structured heat generator being individually superposed on and welded to the two metal foils.

8. A reticulate heater as set forth in claim 7, wherein the metal foil is film-processed by non-ferrous metal having electrical conductivity and corrosion resistance.

9. A reticulate heater as set forth in claim 7, wherein non-ferrous metal having electrical conductivity and corrosion resistance is used as the material of the metal foil.

10. A reticulate heater as set forth in claim 7, wherein the welding between the metal foil and the both end portions of the net-mesh-like-structured heat generator is performed by soldering.

* * * * *